US008015764B2

(12) United States Patent
Yun

(10) Patent No.: US 8,015,764 B2
(45) Date of Patent: Sep. 13, 2011

(54) WINDOW HAVING MEANS FOR TREATING WATER GENERATED BY DEW CONDENSATION

(75) Inventor: Byeong-Hee Yun, Chungcheongbuk-do (KR)

(73) Assignee: LG Chem, Ltd. (KR)

( * ) Notice: Subject to any disclaimer, the term of this patent is extended or adjusted under 35 U.S.C. 154(b) by 135 days.

(21) Appl. No.: 12/309,709

(22) PCT Filed: Jul. 27, 2007

(86) PCT No.: PCT/KR2007/003618

§ 371 (c)(1),
(2), (4) Date: Jul. 7, 2009

(87) PCT Pub. No.: WO2008/013423

PCT Pub. Date: Jan. 31, 2008

(65) Prior Publication Data

US 2009/0313922 A1 Dec. 24, 2009

(30) Foreign Application Priority Data

Jul. 28, 2006 (KR) ..... 10-2006-0071452
Jun. 22, 2007 (KR) ..... 10-2007-0061648

(51) Int. Cl.
*E04B 7/14* (2006.01)

(52) U.S. Cl. ..... 52/209; 52/302.3; 52/235

(58) Field of Classification Search ..... 52/171.1, 52/171.2, 172, 209, 204.52, 204.58, 238, 52/302.1, 302.3, 235; 49/408, 471
See application file for complete search history.

(56) References Cited

U.S. PATENT DOCUMENTS 2,263,495 A * 11/1941 Hare ..... 49/476.1
3,362,123 A * 1/1968 Geyser ..... 52/773
3,845,599 A * 11/1974 Jolly ..... 52/209
3,922,815 A * 12/1975 Hosooka ..... 49/205
5,067,279 A * 11/1991 Hagemeyer ..... 49/471
5,906,083 A * 5/1999 Olsen et al. ..... 52/473
6,357,186 B1 * 3/2002 Gould ..... 52/209
6,427,397 B1 * 8/2002 Kolaschnik ..... 52/204.5
6,823,633 B2 * 11/2004 Ryan ..... 52/302.1
7,669,369 B2 * 3/2010 Henry et al. ..... 49/471
2004/0045235 A1 * 3/2004 Ley et al. ..... 52/235
2005/0166495 A1 8/2005 Cho et al.

FOREIGN PATENT DOCUMENTS

EP 0 745 749 A1 12/1996
GB 2209787 A * 5/1989
JP 6-346667 A 12/1994
KR 20-0351533 5/2004

* cited by examiner

*Primary Examiner* — Robert J Canfield
*Assistant Examiner* — Christine T Cajilig
(74) *Attorney, Agent, or Firm* — Lerner, David, Littenberg, Krumholz & Mentlik, LLP

(57) ABSTRACT

The present invention discloses a window which treats effectively dew-water generated on a window glass to prevent dust, stain and bad smell from being generated and capable of storing dew water in a means for treating dew-water for a certain time to maintain properly an indoor humidity and enhance the air-tightness, water-tightness and adiabatic property.

The window according to the present invention comprises a window frame including a vertical frame for supporting a vertical side of a window glass and a horizontal frame for supporting a horizontal side of the window glass; and a dew-water treating means including a dew-water flow passage provided on the horizontal frame and a drainage trap provided on the window frame for discharging dew water introduced from the dew-water flow passage and stored therein to an outside.

3 Claims, 7 Drawing Sheets

[Fig. 5]
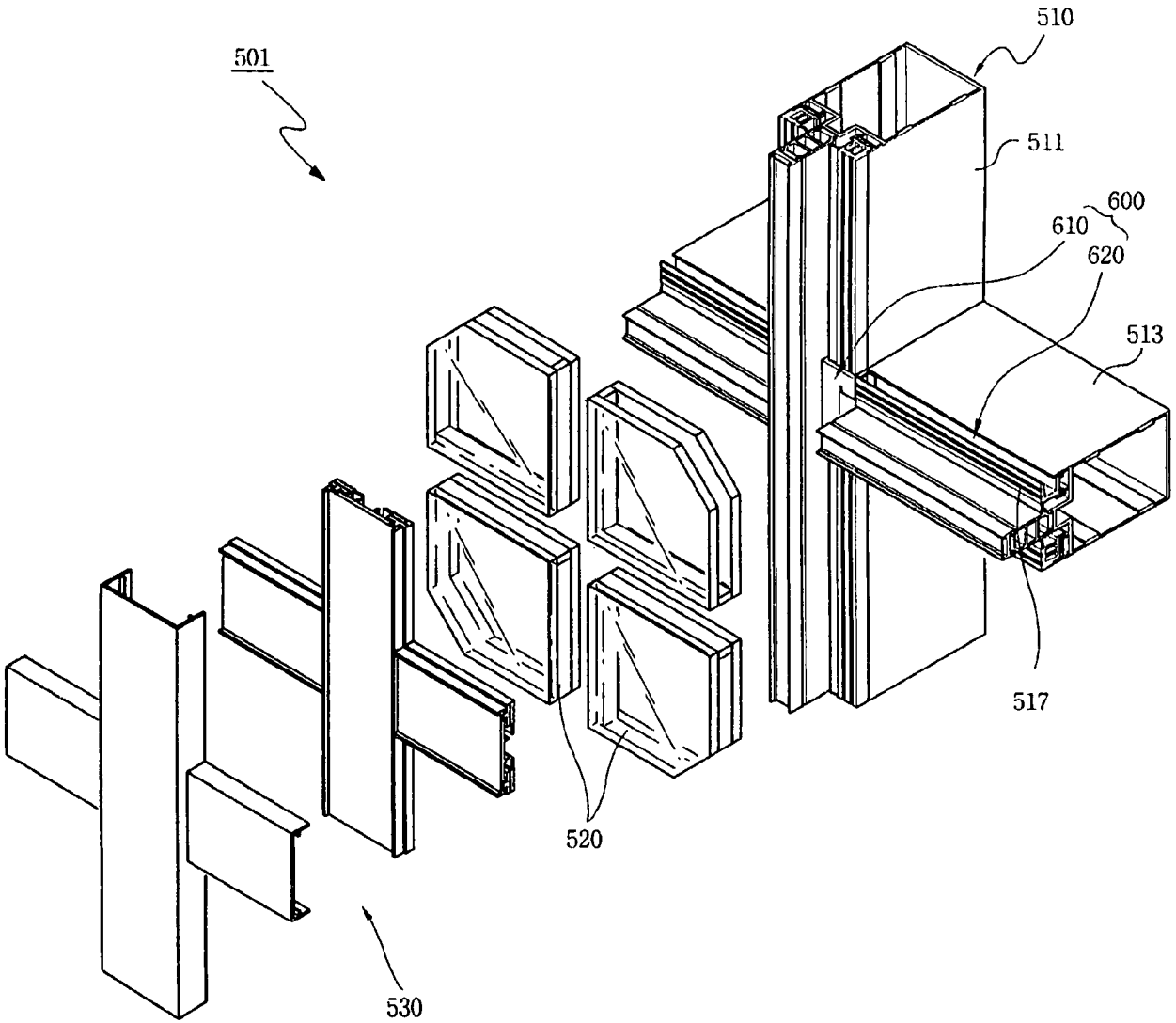

[Fig. 6]
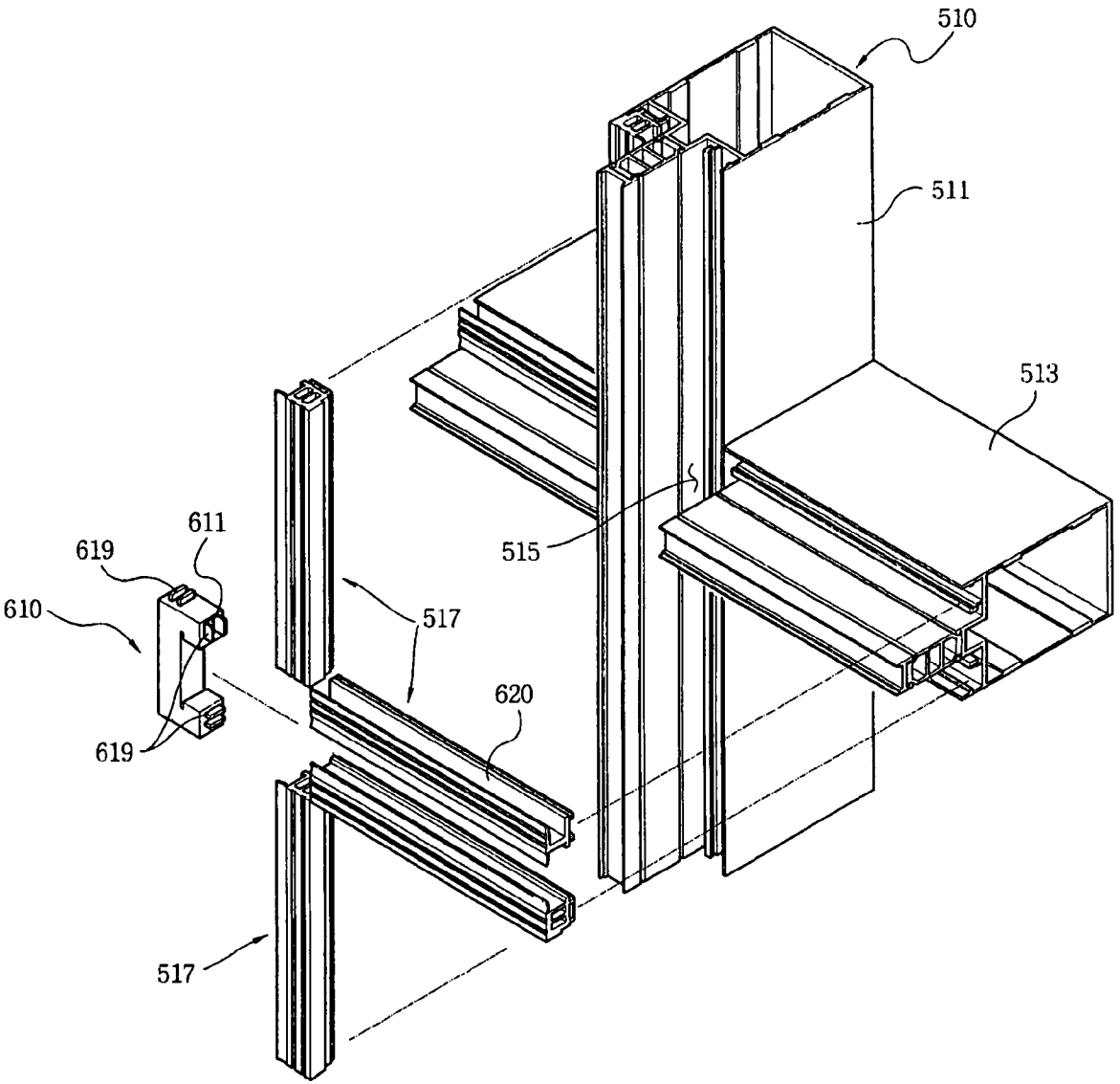

[Fig. 7]
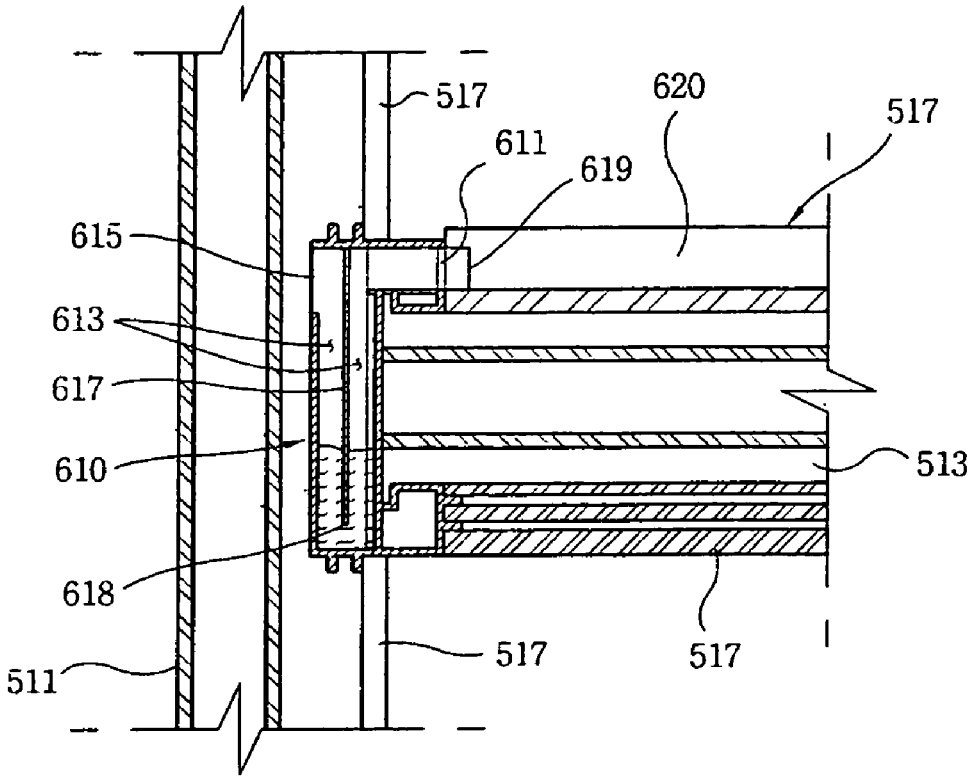
[Fig. 8]
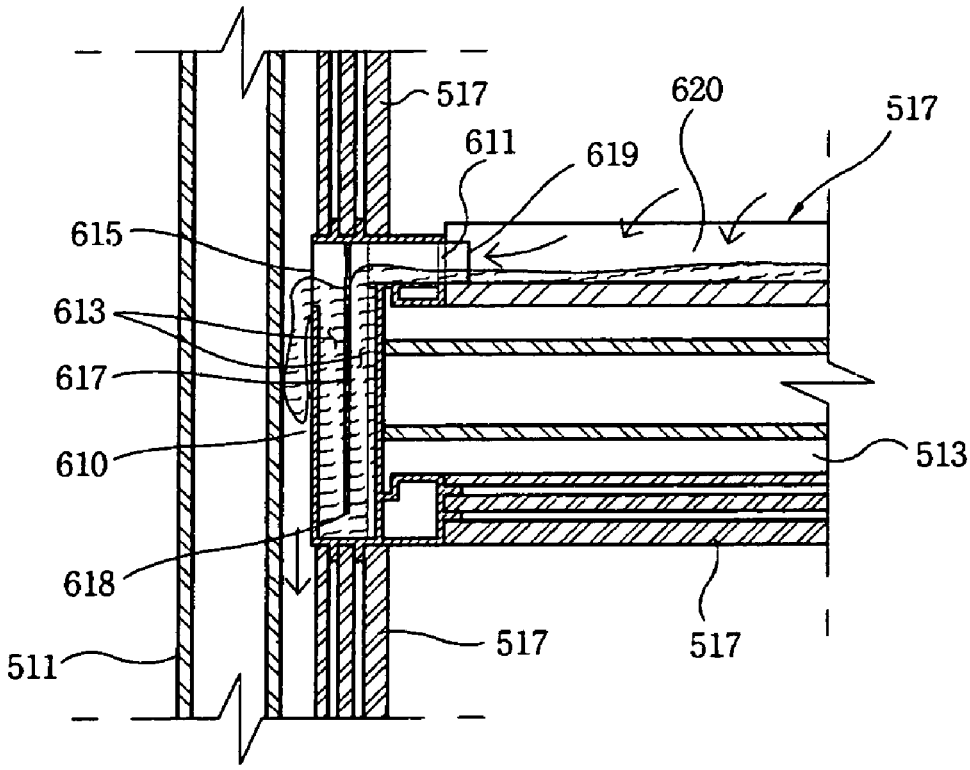

[Fig. 9]
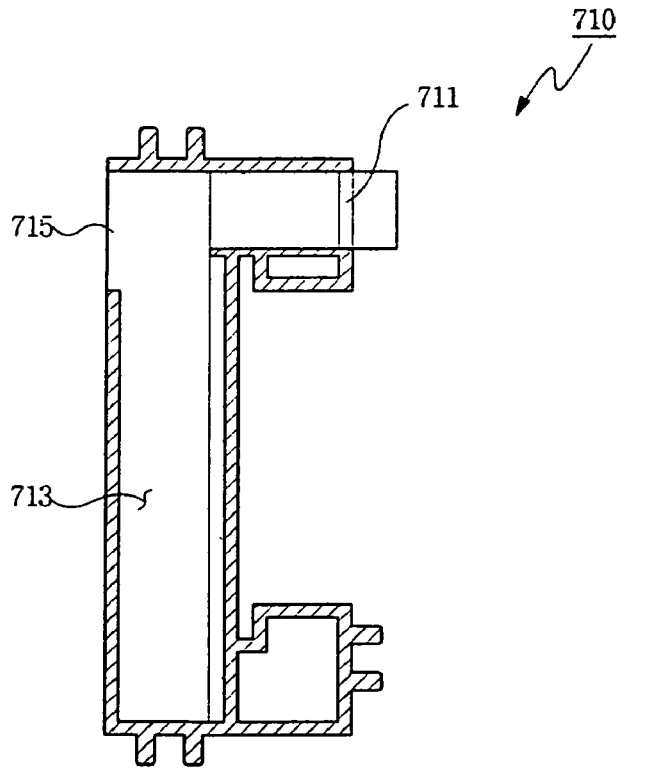
[Fig. 10]
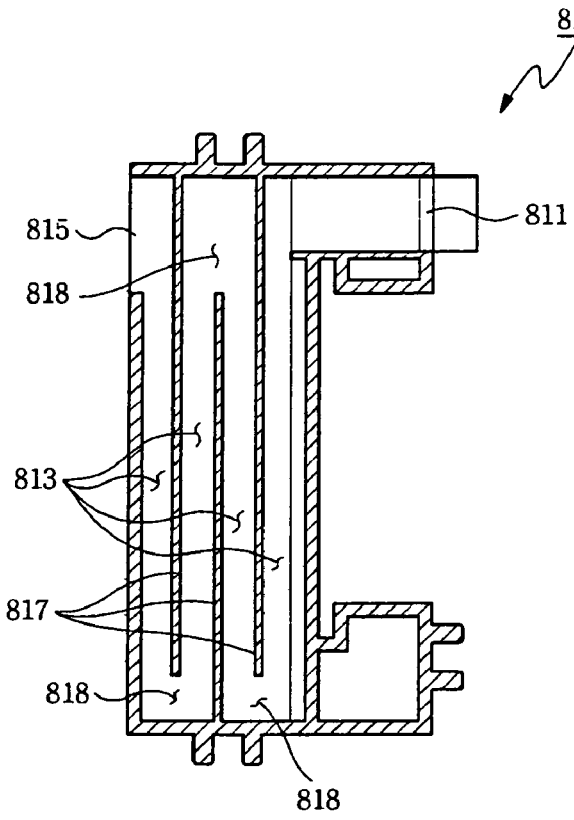

[Fig. 11]
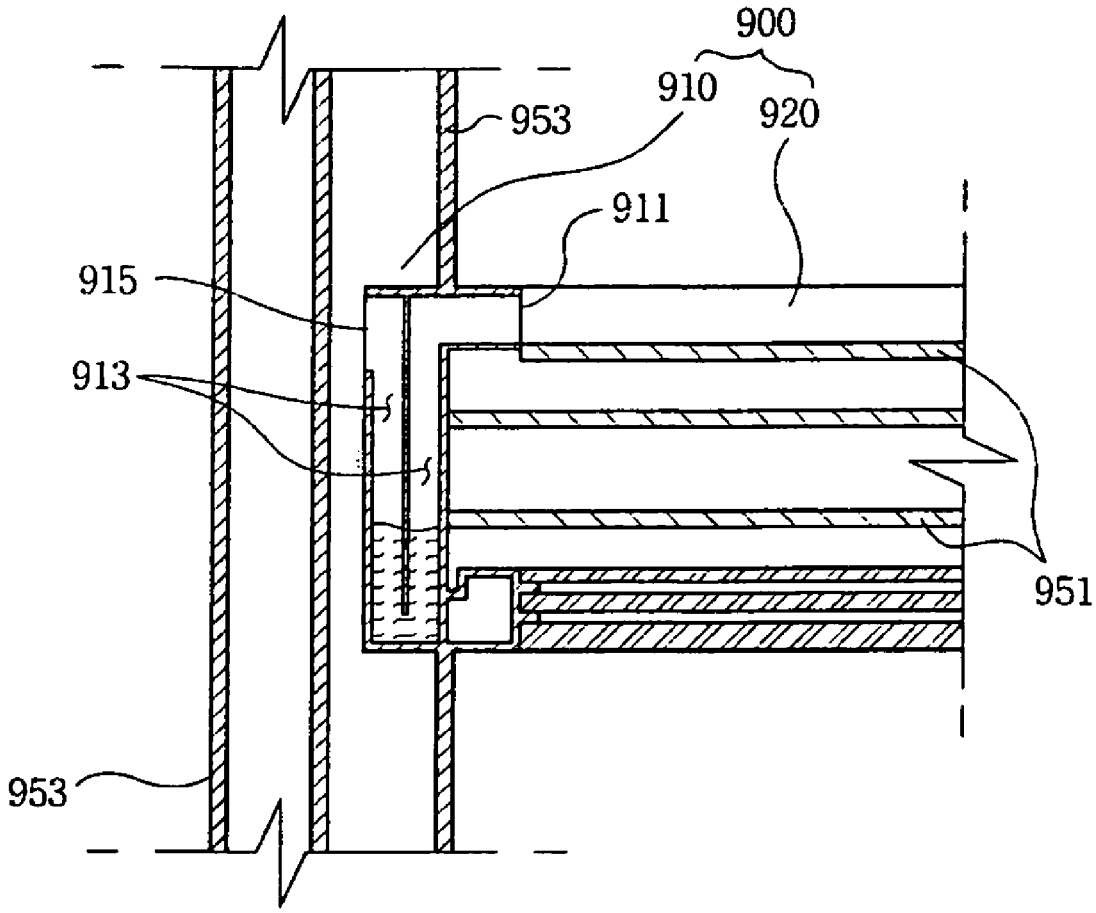

WINDOW HAVING MEANS FOR TREATING WATER GENERATED BY DEW CONDENSATION

CROSS REFERENCE TO RELATED APPLICATIONS

The present application is a national phase entry under 35U.S.C. §371 of International Application No. PCT/KR2007/003618, filed Jul. 27, 2007, published in English, which claims priority from Korean Patent Application No. 10-2006-0071452, filed Jul. 28, 2006 and Korean Patent Application No. 10-2007-0061648, filed Jun. 22, 2007. The disclosures of said applications are incorporated by reference herein.

TECHNICAL FIELD

The present invention relates to a window, more particularly, to a window comprising a dew-water treating means being capable of treating effectively dew-water generated on an indoor side surface of window glass.

BACKGROUND ART

As shown in FIG. 1, a conventional window 101 to be installed in a building comprises a window frame 110 provided at a window opening (not shown) formed on a wall for forming a certain space and a window glass 120 installed in an installing space of the window frame 110.

In these structural members, the window frame 110 may be provided as single frame having a frame shape for forming one installing space for the window glass. As shown in FIG. 1, however, the conventional window frame 110 has a configuration such that the installing space for the window glass is divided into vertical spaces and/or horizontal spaces for installing the window glass. And, the window glass 120 is installed in each installing space and supported by a glass frame 130.

In the conventional window shown in FIG. 1 according to the prior art, there is a problem that once dew-water generated on a surface of the window glass 2210 by a temperature difference between an indoor and an outdoor is flowing down, dew-water is in-flowed in an indoor along a surface of the window frame 210 in an indoor side.

In the conventional window shown in FIG. 1 according to the prior art, there is a problem that once dew-water generated on a surface of the window glass 2210 by a temperature difference between an indoor and an outdoor is flowing down, dew-water is in-flowed in an indoor along a surface of the window frame 210 in an indoor side.

In addition, there is another problem that a portion of the window frame 210 corresponding to an indoor is contaminated by dew-water to defile the appearance of the interior of room.

On the other hand, FIG. 3 is a sectional view taken along the line A-A in FIG. 1 and showing conventional window having another structure;

A structure of a window 301 shown FIG. 3 is substantially the same as that of the aforementioned window shown in FIG. 2, a space 350 for accommodating dew-water is formed at an area of an interior window glass 320 adjacent to a gasket 340 provided at a lower portion of the interior glass frame. This dew-water accommodating space 350 is a depressed space formed on a plate surface of a window frame 310 in a longitudinal direction.

Due to the above structure, once dew-water generated on a surface of the interior window glass 320 is flowing down, dew-water is accommodated in the dew-water accommodating space 350 and then naturally dried so that it is possible to prevent dew-water from being flowed in an indoor or contaminating the window frame 310.

However, the conventional window shown in FIG. 3 has the problem that, due to the above structure, once dew-water generated on a surface of the interior window glass 320 is flowing down, dew-water is accommodated in the dew-water accommodating space 350 and then naturally dried so that it is possible to prevent dew.

On the other hand, FIG. 4 is a sectional view taken along the line A-A in FIG. 1 and showing a conventional window having further another structure.

Like the windows having the structures shown in FIG. 2 and FIG. 3, a window 401 shown in FIG. 4 has a dew-water accommodating space 450 formed on a window frame 410 adjacent to a gasket 440 provided below an interior window glass 420.

In addition, a dew-water drainage port 430 is formed on the window frame 410 to permit the drainage of dew-water from the dew-water accommodating space 450 to an exterior of the window. The window further comprises an additional cover 460 for covering an upper opening of the dew-water accommodating space 450. At this time, a dew-water inflowing port 461 is formed on the cover 460, and so dew-water may be in-flowed into the dew-water accommodating space 450 via the dew-water inflowing port of the cover.

Due to the above structure, dew-water accommodated in the dew-water accommodating space 450 may be drained to an outdoor. Also, even though stains are existed in the dew-water accommodating space 450, these stains are covered with the cover 460 so that the stains are invisible to the naked eye.

However, in the conventional window shown in FIG. 4, since the dew-water accommodating space 450 is formed on the window frame 410 and the separate cover 460 is provided, there is the inconvenience that the cover 460 should be detached from the window frame whenever the dew-water accommodating space 450 is washed. In addition, due to the structures of the dew-water drainage port 430 and the dew-water inflowing port 461 of the cover 460, an air-tightness, water-tightness and adiabatic property of the window become lowered.

On the other hand, a function of the conventional window as described above is limited to remove a dew-water. Accordingly, if the window provides an additional function such as a maintenance of an indoor humidity using dew-water, the window may maintain properly an indoor humidity without an additional means for maintaining an indoor humidity.

DISCLOSURE OF INVENTION

Technical Problem

An object of the present invention is to provide a window which can treat effectively dew-water generated on a window glass to prevent dust, stains and bad smell from being generated.

Another object of the present invention is to provide a window which can accommodate dew-water in a dew-water treating means for a certain time to maintain properly an indoor humidity and has the air-tightness, water-tightness and adiabatic property.

Technical Solution

In order to achieve the above objects, a window according to the present invention comprises a window frame including a vertical frame for supporting a vertical side of a window glass and a horizontal frame for supporting a horizontal side of the window glass; and a dew-water treating means including a dew-water flow passage provided on the horizontal frame and a drainage trap provided on the window frame for discharging dew water introduced from the dew-water flow passage and stored therein to an outside.

Here, the drainage trap comprises a dew-water inflowing port being communicated in fluid with the dew-water flow passage; a dew-water storing space for storing dew-water in-flowed through the dew-water inflowing port; and a dew-water drainage port being communicated in fluid with an upper portion of the dew-water storing space for discharging dew-water stored in the dew-water storing space.

On the other hand, the dew-water storing space is divided into two unit spaces by a partition wall disposed between the dew-water inflowing port and the dew-water drainage port, two unit spaces are communicated in fluid with each other through an opening formed on a lower portion of the partition wall.

The dew-water storing space having another structure is divided into a plurality of unit spaces by partition walls disposed between the dew-water inflowing port and the dew-water drainage port. At this time, the unit spaces are communicated in fluid with each other through openings formed on the partition walls and the openings are formed alternatively on upper portions and lower portions of the partition walls.

Here, the dew-water flow passage may be a groove formed on an upper side of a gasket provided between the window glass and the horizontal frame or a groove formed on an upper surface of the horizontal frame in the longitudinal direction.

Advantageous Effects

As described above, in the window according to the present invention, a generation of dust, stains and bad smell is prevented by a dew-water treating means comprising a drainage trap, a process for washing the window is easily carried out, and the excellent air-tightness, water-tightness and adiabatic property can be obtained.

In addition, the window according to the present invention has an advantage in that an indoor humidity can be approximately maintained by dew-water accommodated in the dew-water treating means.

BRIEF DESCRIPTION OF THE DRAWINGS

The above and other objects, features and advantages of the present invention will become apparent from the following description of preferred embodiments given in conjunction with the accompanying drawings, in which:

FIG. 5 and FIG. 6 are partial exploded perspective views of a window according to one embodiment of the present invention, and corresponds to "B" portion in FIG. 1;

FIG. 7 and FIG. 8 are partial sectional views of a region on which a means for treating dew water shown in FIG. 5 and FIG. 6 is provided;

FIG. 9 and FIG. 10 are sectional views of a drainage trap constituting a means for treating dew water used in the present invention; and FIG. 11 is a partial sectional view of a region of a window on which a means for treating dew water according to another embodiment of the present invention is installed.

BEST MODE FOR CARRYING OUT THE INVENTION

Hereinafter, the present invention will be described in detail with reference to accompanying drawings.

Figure 1:
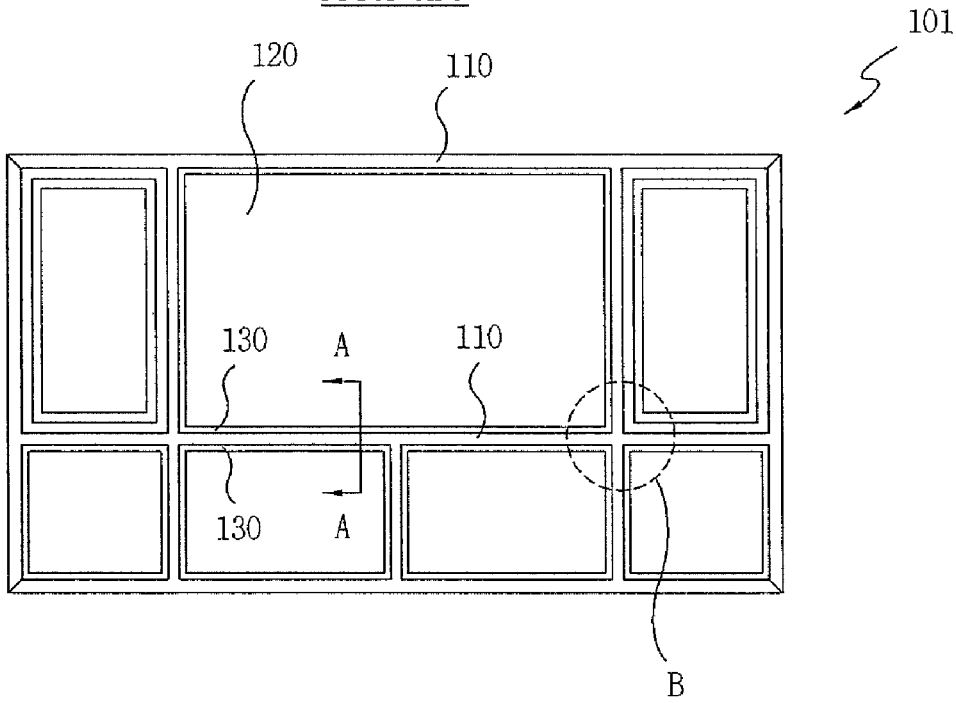
Fig 1. Prior Art
FIG. 1 is a front view of a conventional window.
Figure 2:
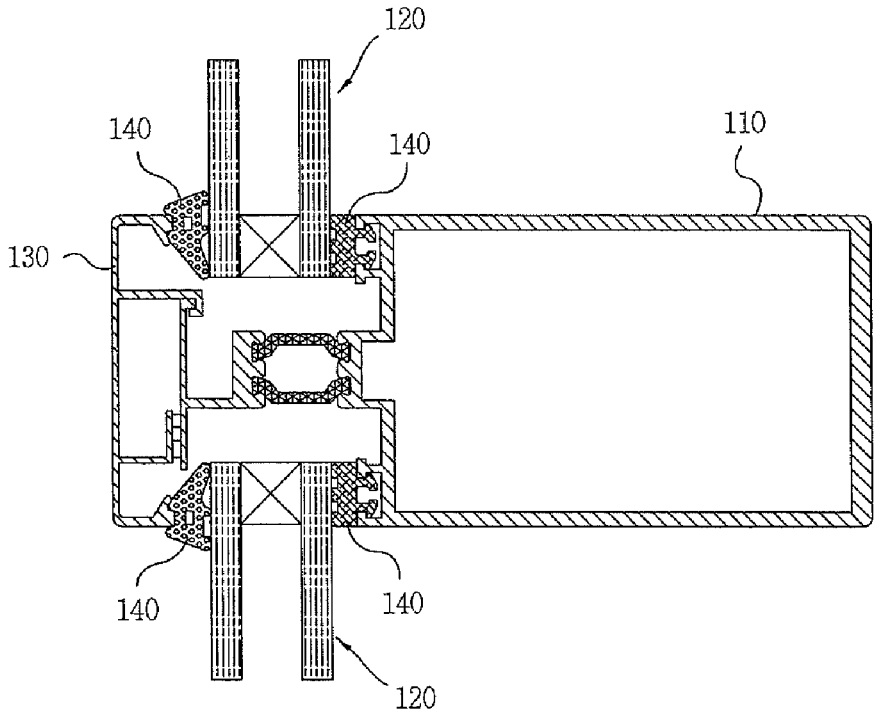
Fig 2. Prior Art
FIG. 2 is a sectional view taken along the line A-A in FIG. 1 and showing a structure of a conventional window.
Figure 3:
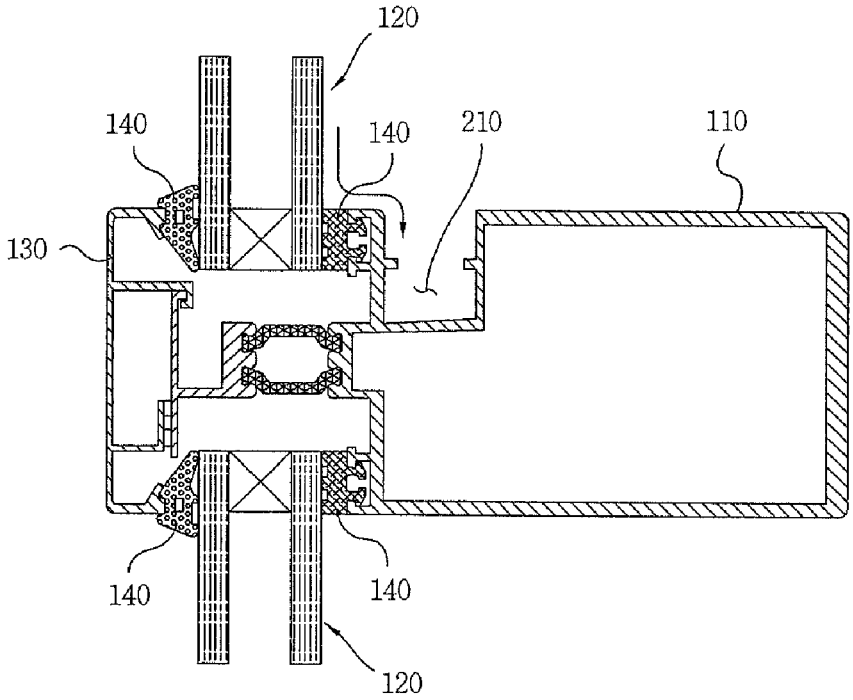
Fig 3. Prior Art
FIG. 3 is a sectional view taken along the line A-A in FIG. 1 and showing conventional window having another structure.
Figure 4:
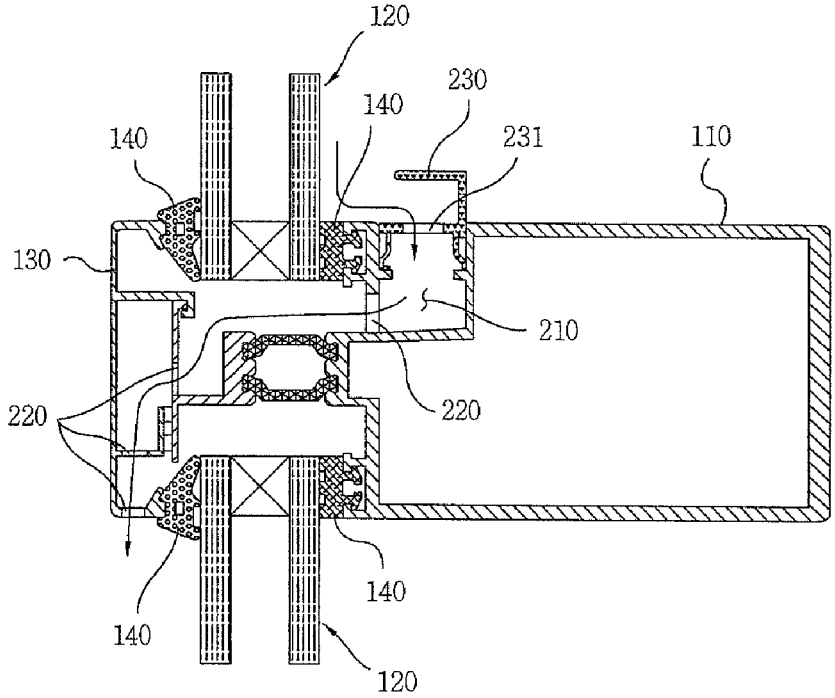
Fig 4. Prior Art
FIG. 4 is a sectional view taken along the line A-A in FIG. 1 and showing a conventional window having further another structure.

FIG. 5 and FIG. 6 are partial exploded perspective views of a window according to one embodiment of the present invention, and corresponds to "B" portion in FIG. 1. Also, FIG. 7 and FIG. 8 are partial sectional views of a region on which a means for treating dew water shown in FIG. 5 and FIG. 6 is provided;

Like the conventional window, as shown in the above figures, a window according to one embodiment of the present invention comprises a window frame 510 forming spaces for installing window glasses 520 and a dew-water treating means 600 provided on the window frame 510.

The window frame 510 is provided in an opening (not shown) formed on a wall (not shown) and comprises vertical frames 511 and horizontal frames 513 forming spaces for installing the window glasses 520 and supporting vertical sides and horizontal sides of the window glass 520, respectively.

The window glasses 520 are supported by a glass support frame 530 and the glass support frame 530 is installed at an outdoor region of the window frame 510. At this time, gaskets 517 are provided between the window glass 520 and the window frame 510 and between the window glass 520 and the glass support frame 530 for air-tightness and water-tightness. On an indoor side of the window frame 510, a space 515 is formed at a region at which the vertical frame 511 intersects, and a drainage trap 610 described is installed in the space 515.

In addition, a drainage port (not shown) extended toward an outdoor is formed on a lower region of the window frame 510. Dew-water discharged from the drainage trap 610 described later is fallen down to an inner space of the window frame 510 and then drained to an outside through the drainage port (not shown).

Meanwhile, the dew-water treating means 600 comprises a dew-water flow passage 620 for guiding dew-water fallen down an indoor surface of the window glass 520 to the vertical frame 511 and the drainage trap 610 storing dew-water introduced from the dew-water flow passage 620 for a certain time and then discharging dew-water to an outside through the vertical frame 511.

A gasket 517 is provided between a lower region of an indoor side of the window glass 520 and the horizontal frame 513, and a groove 620 is formed on the gasket 517 in the longitudinal direction. This groove 620 functions as the flow passage for dew water (Hereinafter, this groove is referred to as "dew-water flow passage").

Dew-water generated on an indoor surface of the window glass 520 is fallen down to the dew-water flow passage 620 along a surface of the window glass 520 by its own weight, and then in-flowed in the drainage trap 610 provided in the vertical frame 511.

The drainage trap 610 comprises a dew-water inflowing port 611 provided in the vertical frame 511 adjacent to the horizontal frame 513; a dew-water storing space 613 for storing dew-water introduced through the dew-water inflowing port 611 for a certain time; and a dew-water drainage port 615 for discharging dew-water stored in the dew-water storing space into the vertical frame 511.

The dew-water inflowing port 611 is formed at an upper region of one surface of the drainage trap 610 for allowing the dew-water inflowing port to communicate in fluid with the dew-water flow passage 620, and the dew-water drainage port 615 is formed at an upper region of the other surface of the drainage trap 610 which is opposite to the dew-water inflowing port 611 for allowing the dew-water drainage port to communicate in fluid with the vertical frame 511.

And, an inner space of the drainage trap 610 below the dew-water inflowing port 611 and the dew-water drainage port 615 acts as the dew-water storing space 613 for storing dew-water. Dew-water introduced in the dew-water storing space 613 is remained in the dew-water storing space 613 unless dew-water is drained through the dew-water drainage port 615.

Here, the dew-water storing space 613 can be divided into two unit spaces by a partition wall 617 as shown in FIG. 7 and FIG. 8. At this time, an opening 618 is formed at a lower portion of the partition wall 617 so that the dew-water storing space 613 has a U shape in section. Due to the above structure, dew water is flowed along the U-shaped flow path so that a time required for flowing dew water from the dew-water inflowing port to the dew-water drainage port may be increased.

In the drainage trap 610, in addition, it is preferable to form gasket coupling sections 619 on an upper end, a lower end and a portion adjacent to the horizontal frame 513, and so the gasket 517 is coupled hermetically with the drainage trap. Due to the above structure, it is possible to prevent a leakage of dew water caused by a gap between the dew-water flow passage 620 and the drainage trap 610.

On the other hand, FIG. 9 and FIG. 10 are sectional views showing an inner structure of a drainage trap having another structure.

As shown in FIG. 9, a dew-water storing space 713 in a drainage trap 710 may be formed as a single space. This structure may be utilized when there is need to minimize a time required for flowing dew water from a dew-water inflowing port 711 to a dew-water drainage port 715.

In addition, as shown in FIG. 10, a dew-water storing space 813 in a drainage trap 810 may be divided into a plurality of unit spaces by a plurality of partition walls 817. At this time, openings 818 are formed alternatively on upper portions and lower portion of the partition walls 817, and so a flow passage for dew-water from a dew-water inflowing port 811 to a dew-water drainage port 815 is maximized. Consequently, a time required for flowing dew water in a drainage trap 810 can be more increased.

FIG. 11 is a partial sectional view of a region of a window on which a means for treating dew water of a window according to another embodiment of the present invention is installed. As shown in FIG. 11, a means 900 for treating dew water according to this embodiment used in the window comprises a dew-water flow passage 920 formed on a window frame 950 and a drainage trap 910.

A groove 920 is formed on an upper surface of a horizontal frame 951 adjacent to a lower region of an indoor side of a window glass (not shown) in a longitudinal direction, and the drainage trap 910 is formed integrally in a vertical frame 953. In the window according to the present invention, the groove 920 formed on an upper surface of the horizontal frame 951 functions as a dew water flow passage.

Like the aforementioned embodiment, the drainage trap 910 comprises a dew-water inflowing port 911 to which dew-water is introduced; a dew-water storing space 913 for storing dew-water introduced through the dew-water inflowing port 911 for a certain time; and a dew-water drainage port 915 for discharging dew-water stored in the dew-water storing space into the vertical frame 953.

Here, like the aforementioned embodiment, the dew-water storing space 913 in the drainage trap 910 may be formed as a single space or may be divided into a plurality of unit spaces.

Below, a process for treating dew-water on the window according to the present invention is described in detail with reference to FIG. 7 and FIG. 8.

Once dew-water generated on an indoor surface of the window glass 520 is fallen down, dew-water is introduced into the dew-water flow passage 620 formed on the gasket 517 mounted on the horizontal frame 513. Dew-water is then flowed to the vertical frame 511 along the dew-water flow passage 620 and introduced into the dew-water storing space 613 through the dew-water inflowing port 611 of the drainage trap 610. At this time, due to a flow of dew-water, foreign substance such as dust and the like is not remained in the dew-water flow passage 620. By the above phenomenon, it is possible to prevent the dew-water flow passage 620 from being contaminated and to clean easily the dew-water flow passage.

And, once a level of dew-water in the dew-water storing space 613 rises and dew-water is introduced into the dew-water drainage port 615, dew water is fallen down to a lower portion in the vertical frame 511 and then discharged to an exterior through a drainage port (not shown) formed at a lower region of the window frame 510.

On the other hand, if dew-water does not flow into the dew-water storing space 613, dew-water is remained in the dew-water storing space 613 within a water level which is the same as a height of the dew-water drainage port 615. Dew-water remained in the drainage trap 610 functions as a role of a mean for isolating an outdoor from the interior of room, and so it is possible to secure an air-tightness, a water-tightness and adiabatic property of the window.

In addition, dew-water remained in the dew-water storing space 613 is in charge of maintaining an indoor humidity so that an indoor humidity may be maintained properly without providing the additional means for adjusting the humidity in an interior of room.

As described above, in the window according to the present invention, since dew-water generated on an indoor side of the window glass is introduced into the drainage tramp through the dew-water flow passage, foreign substance such as dust and the like is not remained in the dew-water flow passage or on the window frame by a flow of dew-water. Due to the phenomenon, it is possible to prevent the dew-water flow passage and the window frame from being contaminated and to clean easily the dew-water flow passage and the window frame.

Also, dew-water flowed into the drainage trap is maintained in the dew-water storing space for a certain time and functions as a role of a mean for isolating an outdoor from the interior of room, and so it is possible to secure the air-tightness, the water-tightness and the adiabatic property of the window and to maintain properly the indoor humidity.

In the above description, even though the structure in which the dew-water flow passage is formed on an entire area of the horizontal frame in a longitudinal direction and the drainage trap is provided on the vertical trap is illustrated, an area on which the dew-water flow passage is formed and a structure of the dew-water flow passage can be variously modified. Accordingly, the drainage trap can be properly formed on the vertical frame or the horizontal frame. And, it goes without saying that a structure of the drainage trap may be modified variously.

In addition, according to the present invention, at least one of the dew-water flow passage and the drainage trap may be formed integrally with the window frame and the other can be provided as the separate member.

INDUSTRIAL APPLICABILITY

The present invention is applicable to a window comprising a dew-water treating means being capable of treating effectively dew-water generated on an indoor side surface of window glass.

The invention claimed is:

1. A window, comprising;

a window frame including a vertical frame for supporting a vertical side of a window glass and a horizontal frame for supporting a horizontal side of the window glass; and a dew-water treating means comprising a dew-water flow passage provided on the horizontal frame and a drainage trap provided on the vertical frame for discharging dew water introduced from the dew-water flow passage and stored therein to an outside, wherein the drainage trap comprises;

a dew-water inflowing port communicating with the dew-water flow passage;

a dew-water storing space for storing the dew-water inflowed through the dew-water inflowing port; and a dew-water drainage port communicating with an upper portion of the dew-water storing space for discharging the dew-water stored in the dew-water storing space, wherein the dew-water storing space is divided into a plurality of unit spaces by partition walls disposed between the dew-water inflowing port and the dew-water drainage port, the unit spaces are communicating with each other through openings formed on the partition walls, wherein the openings are formed alternatively on upper portions and lower portions of the partition walls, wherein a gasket is provided between the window glass and the horizontal frame, and the dew-water flow passage is a groove formed on an upper portion of the gasket, and wherein the drainage trap has gasket coupling sections formed on outside portions thereof corresponding to longitudinal end portions of the gasket.

2. The window of claim 1, wherein the drainage trap is formed integrally with the window frame.

3. The window of claim 1, wherein the window frame comprises a drainage port formed on a lower portion thereof and directed to an outdoor.

* * * * *

UNITED STATES PATENT AND TRADEMARK OFFICE

CERTIFICATE OF CORRECTION

PATENT NO. : 8,015,764 B2
APPLICATION NO. : 12/309709
DATED : September 13, 2011
INVENTOR(S) : Byeong-Hee Yun It is certified that error appears in the above-identified patent and that said Letters Patent is hereby corrected as shown below:

Column 1, line 43, "2210" should read --220--.

Column 1, lines 46-53, delete the duplicate paragraph starting with "In the conventional window shown in FIG. 1" and ending with "in an indoor side.".

Column 1, line 59, "showing conventional" should read --showing a conventional--.

Column 2, line 30, "are existed" should read --exist--.

Column 3, line 57, "showing conventional window" should read --showing a conventional window--.

Column 3, line 64, "corresponds" should read --corresponding--.

Column 4, line 12, "reference to accompanying" should read --reference to the accompanying--.

Column 4, line 42, "is fallen" should read --falls--.

Column 4, line 43, "drained" should read --drains--.

Column 5, line 15, "is remained" should read --remains--.

Column 6, line 19, "dew-water, foreign" should read --dew-water, a foreign--.

Column 6, line 33, "is remained" should read --remains--.

Column 6, line 44, "interior of room" should read --interior of a room--.

Column 6, line 47, "tramp" should read --trap--.

Column 6, line 48, "passage, foreign substance" should read --passage, a foreign substance--.

Column 6, line 57, "mean" should read --means--.

Signed and Sealed this
Twelfth Day of March, 2013

Teresa Stanek Rea
*Acting Director of the United States Patent and Trademark Office*